US005657515A

United States Patent [19]

Bert

[11] Patent Number: 5,657,515

[45] Date of Patent: Aug. 19, 1997

[54] END CONNECTOR

[75] Inventor: Stephen F. Bert, North Scituate, R.I.

[73] Assignee: Textron, Inc., Providence, R.I.

[21] Appl. No.: 680,778

[22] Filed: Jul. 16, 1996

[51] Int. Cl.[6] ..... A44C 5/18

[52] U.S. Cl. ..... 24/265 WS; 24/265 B

[58] Field of Search ..... 24/265 WS, 265 B; 59/79.1

[56] References Cited

U.S. PATENT DOCUMENTS 4,958,334 9/1990 Grosjean ..... 368/282

5,090,094 2/1992 Bert ..... 24/265 WS

*Primary Examiner*—James R. Brittain

*Attorney, Agent, or Firm*—Samuels, Gauthier, Stevens & Reppert

[57] ABSTRACT

An end connector for an expansible watch band has a plastic insert sandwiched between metallic bottom and top plates. The plastic insert has forwardly projecting mutually spaced lugs enclosed by preformed mutually spaced bottom and top flanges on the bottom and top plates.

7 Claims, 2 Drawing Sheets

END CONNECTOR

BACKGROUND OF THE INVENTION

1. Field of the Invention

This invention relates generally to expansible watchbands, and is concerned in particular with an improved end connector assembly for coupling the ends of such watchbands to watches having watch cases which may either be metallic or molded from plastic materials such as for example ABS.

2. Description of the Prior Art

The conventional expansible watchband typically includes a row of top links overlying a row of bottom links, with each bottom link being interconnected to two adjacent top links by pairs of U-shaped staples. Springs housed in the links coact with the staples to yieldably contract the band. The top and bottom links as well as the staples and springs are typically fabricated as metal stampings, and the top links are usually covered with decorative metallic top shells.

In the past, as disclosed for example in U.S. Pat. No. 4,958,334 (Grosjean), such watchbands have been coupled to plastic watch cases by end connectors employing both metallic and plastic components. The plastic component consists of an insert captured between top and bottom metallic plates. The top plate is configured and decoratively finished, often by gold plating, to comport in appearance with the decorative top shells of the watchband. The plastic insert serves to isolate the plastic watch case from damaging frictional contact with the metallic components of the end connector.

The plastic insert is provided with forwardly projecting mutually spaced lugs configured and dimensioned for assembly in a mortise and tenon relationship with a mating set of mutually spaced lugs projecting from the side of the watch case. Apertures in the thus assembled lugs are aligned to receive a metallic pin which serves to pivotally join the end connector to the watch case. The lugs of the plastic insert serve to grip and hold the pin in place.

The top plate of the end connector assembly includes forwardly projecting flanges which during assembly are rolled around the plastic lugs of the insert, thereby concealing the plastic lugs from view while at the same time contributing to the secure mechanical coupling of the insert between the metallic top and bottom plates of the connector.

There are several drawbacks associated with this arrangement. For example, when rolling the forwardly projecting flanges of the top plate around the lugs of the plastic insert, it is difficult to achieve uniformity and precision because the plastic lugs are relatively soft and deformable and as such, do not provide stable platforms during the bending operation. Also, in order to provide flanges with sufficient lengths to reach around the plastic lugs, the overall length of the top plate must be increased. Because the material of the top plate is usually plated or otherwise expensively finished, any increase of its dimensions contributes unfavorably to the cost of the end connector. Pronounced bending of the top flanges can also cause cracking of the plated surfaces of the top plate.

SUMMARY OF THE INVENTION

In accordance with the present invention, the bottom and top plates of the connector are each provided with forwardly projecting flanges. The flanges are preformed during the initial stamping operation, thereby assuring uniformity and precision. The flanges of the lower plate are configured to underlie and partially surround the forwardly projecting plastic lugs of the insert. The flanges of the top plate are likewise configured to partially surround and overlie the plastic lugs. The top flanges cooperate in an overlapped relationship with the flanges of the bottom plate to securely enclose the plastic lugs. The top flanges need only be long enough to partially reach around the surfaces of the plastic lugs, thus enabling the overall length of the top plate to be shortened, with a concomitant savings in material costs. This also limits the severity of bending required to form the top flanges, which in tom lessens the risk of cracking or otherwise damaging plated surfaces.

BRIEF DESCRIPTION OF THE DRAWINGS

These and other objects and advantages of the present invention will become more apparent as the description proceeds with the aid of the accompanying drawings, wherein.

DETAILED DESCRIPTION OF PREFERRED EMBODIMENT

Figure 1:
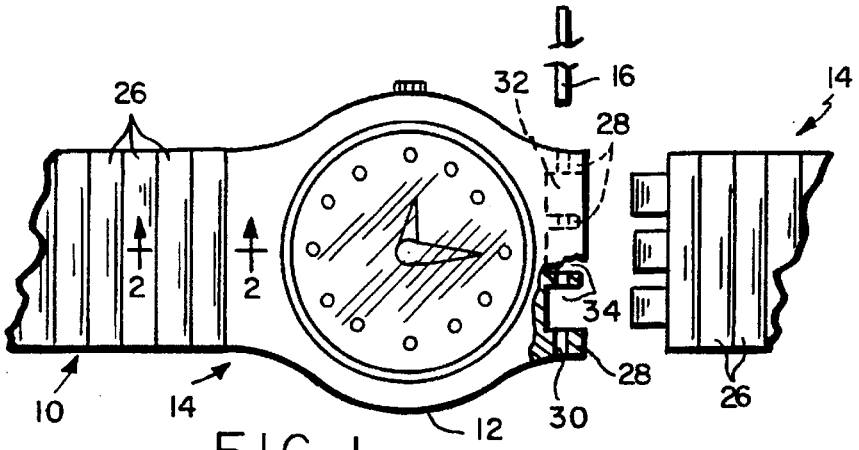
FIG. 1 is a partial top plan view showing a watchband connected at one end to a watch case by means of an end connector in accordance with the present invention, and showing the end connector at the opposite end of the watchband uncoupled from the watch case.

Referring initially to FIG. 1, one end of an expansible watchband 10 is shown coupled to a watch case 12 by means of an end connector 14 in accordance with the present invention. The end connector at the opposite end of the watchband is shown uncoupled from the watch case as a result of the extraction of a metallic cross pin 16.

Figure 2:
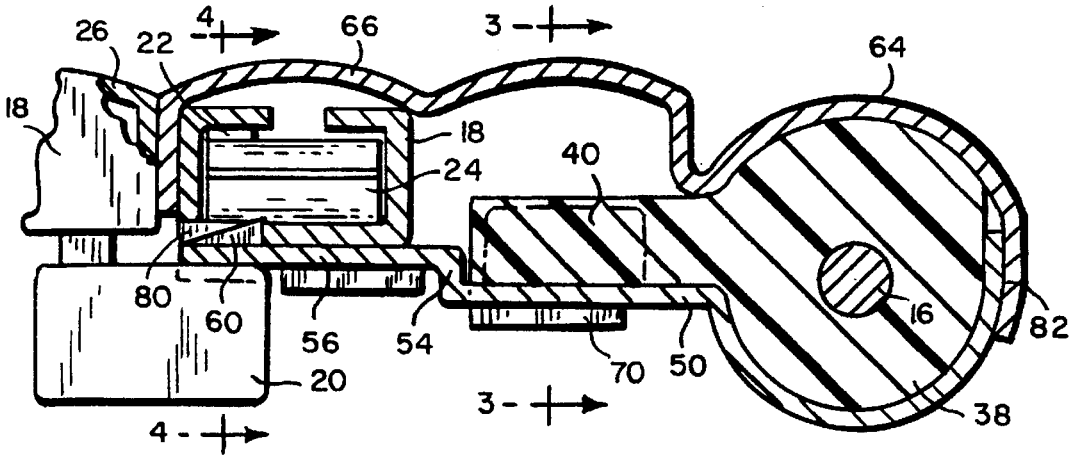
FIG. 2 is a sectional view on an enlarged scale taken along line 2—2 of FIG. 1.
Figure 3:
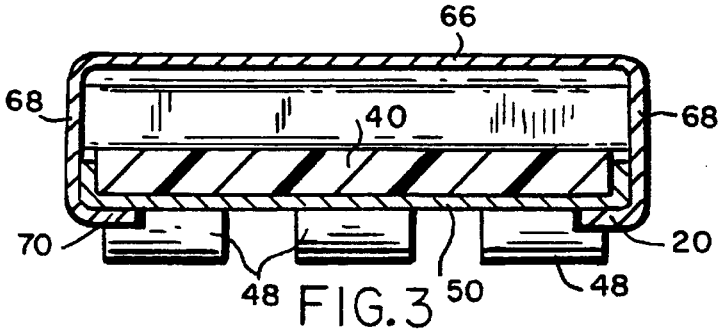
FIGS. 3 and 4 are sectional views taken respectively on lines 3—3 and 4—4 of FIG. 2.
Figure 4:
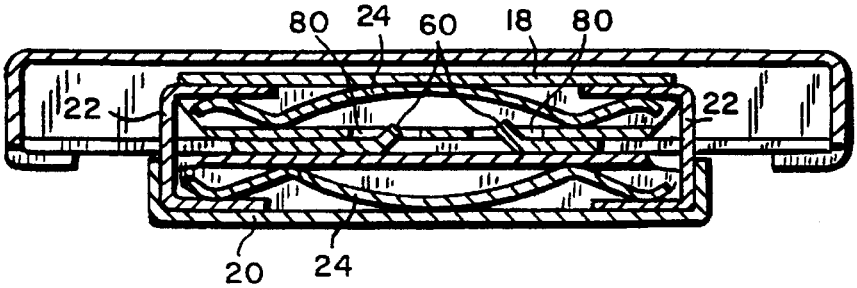

Referring additionally to FIGS. 2–4, it will be seen that the watchband is of known construction, comprising a row of top links 18 overlying a row of bottom links 20. Each bottom link 20 is connected to two top links 18 by means of opposing pairs of U-shaped staples 22, the latter being acted upon by leaf springs 24 housed in the links. The leaf springs coact in resilient engagement with the staples to accommodate longitudinal expansion and contraction of the band in a manner well known to those skilled in the art. The top links 18 are covered by decorative top shells 26 which in the present case are metallic.

The watch case 12 has opposite sides configured to provide mutually spaced first lugs 28 with aligned first apertures 30 extending therethrough. The lugs 28 underlie an integral shelf portion 32 of the watch case and the define first sockets 34 therebetween.

Figure 5:
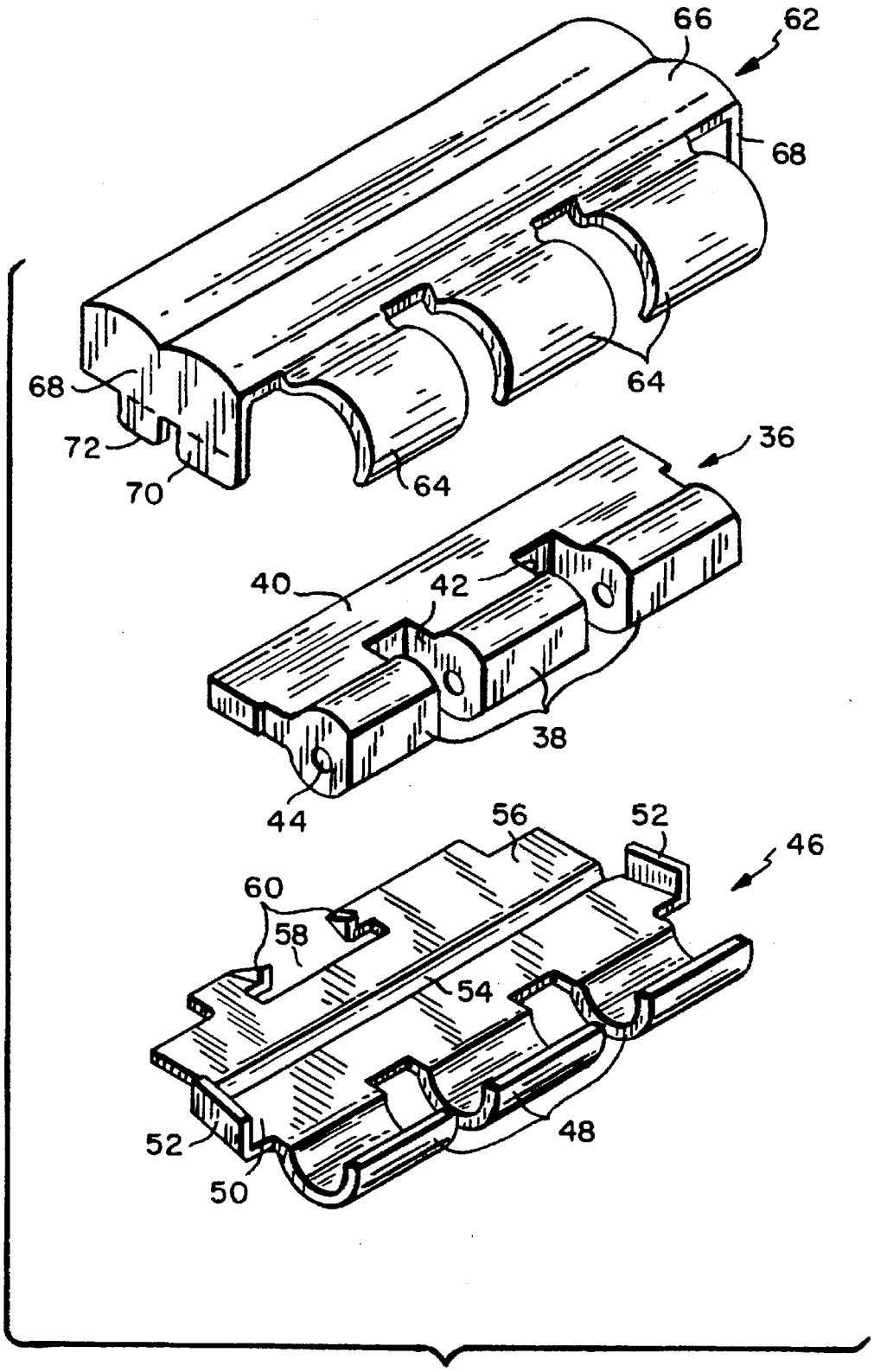
FIG. 5 is an exploded view, in perspective, of the major components of the end connector.

With reference additionally to FIG. 5, it will be seen that each end connector 14 includes a plastic filler piece 36 having second lugs 38 at its forward end, and having a generally planar rear end 40. The second lugs 38 are separated by second sockets 42 and have second mutually aligned apertures 44 extending therethrough.

A metal bottom plate 46 underlies the plastic filler piece 36. The bottom plate comprises a preshaped metal stamping having a front end with forwardly projecting mutually spaced bottom flanges 48 projecting forwardly from a planar intermediate section 50. The intermediate section 50 has upturned sides 52, and is integrally joined at a step 54 to a planar rear end 56. The rear end is notched as at 58 and is provided with upturned rearwardly tapering locking flanges 60.

A metal top plate 62 is arranged to overlie the plastic filler piece 36. The top plate 62 is a metallic stamping having mutually spaced top flanges 64 projecting forwardly from its front end, with a rear end providing a cover 66 shaped to conform to the shape of the decorative top shells 26 of the watchband. Side walls 68 depend from the cover 66 and are provided with deformable tabs 70, 72.

During assembly, the plastic filler piece 36 is placed on the bottom plate 46. The plastic second lugs 38 have curved upper and lower surfaces leading from the planar rear end 40 to generally flat front faces. The bottom flanges 48 are aligned with and are configured to underlie and partially surround the second lugs 38, with the planar rear end 40 of the plastic filler piece lying on and being supported by the planar intermediate section 50 of the bottom plate.

The planar rear end 56 of the bottom plate is configured and dimensioned to be received between the endmost top and bottom links 18, 20 of the watchband, with the upturned locking flanges 60 of the bottom plate coacting in mechanical interengagement with receiving slots 80 in the end most top link 18. The rearwardly tapering configuration of the locking flanges 60 facilitates insertion of the rear end of the bottom plate into its interengaged position with the top link.

The top plate 62 is then assembled onto the bottom plate 46 in a position overlying the plastic filler piece 36 and at least the endmost top link 18 of the watchband. The top flanges 64 are aligned with the bottom flanges 48 to cooperate therewith in enclosing the plastic lugs 38 therebetween. As can best be seen in FIG. 2, the top flanges are arranged to overlap the bottom flanges as at 82. The rear cover portion 66 of the top plate overlies both the intermediate and rear sections 50, 56 of the bottom plate, thereby capturing the endmost top link 18 therebetween. The deformable tabs 70, 72 are then bent inwardly around the underside of the bottom plate 46, thereby interconnecting the top and bottom plates. This completes the assembly of the end connector.

The end connector 14 may then be coupled to the watch case, with the first and second lugs 28, 38 being assembled in a mortise and tenon relationship, and with the first and second apertures 30, 44 in mutual alignment to receive a cross pin 16.

In light of the foregoing, it will now be appreciated by those skilled in the art that the present invention offers unique advantages not heretofore available with prior art end connectors. Of particular importance is the confinement of the plastic lugs 38 between both the upper and lower flanges 64, 48 of the top and bottom plates 62, 46, with the flanges having been accurately preformed prior to assembly. The resulting uniformity and close tolerances contribute to a superior appearance and ease of assembly.

By employing bottom flanges 48 shaped to partially surround the undersides of the plastic lugs 38, the top flanges 64 can be shortened, thereby reducing the overall length of the top plate 62. Since the top plate is usually gold plated or otherwise expensively finished, it is relatively expensive as compared to the bottom plate, which is usually not decoratively finished. Thus any reduction in size of the top plate results in beneficial cost savings.

Also, the plating applied to the top plate is somewhat prone to cracking when subjected to severe bending. The present invention avoids any severe bending of the top flanges 64 during assembly, and thus eliminates this problem.

I claim:

1. A connector for joining an end of an expansible watch band to a watch case, the end of said watch band terminating in top and bottom end links interconnected by a pair of mutually spaced spring-biased staples, the watch case having first lugs separated by first sockets, with aligned first apertures extending through said first lugs, said connector comprising:

a plastic filler piece having second lugs separated by second sockets, with aligned second apertures extending through said second lugs;

a metal bottom plate underlying said plastic filler piece, said bottom plate having a front end and a rear end, the front end of said bottom plate having spaced bottom flanges aligned with and configured to underlie and partially surround said second lugs, the rear end of said bottom plate being configured and dimensioned to be received between said top and bottom end links;

a metal top plate overlying said plastic filler piece, said top plate having a front end and a rear end, the front end of said top plate having mutually spaced top flanges aligned and cooperating with said bottom flanges to enclose said second lugs therebetween, the rear end of said top plate being configured and dimensioned to overlie the rear end of said bottom plate and the top end link of said watch band;

means for interconnecting said top and bottom plates to capture said plastic filler piece and the top end link of said watchband therebetween, said first and second lugs being adapted to be received respectively in said second and first sockets with said first and second apertures in mutual alignment; and a metallic pin inserted through said first and second aperature to establish a pivotal connection between said watch case and said end connector.

2. The connector as claimed in claim 1 wherein said second lugs are particularly curved in cross section, and wherein said top and bottom flanges have partially curved configurations.

3. The connector as claimed in claims 1 or 2 wherein said top flanges partially overlap said bottom flanges.

4. The connector as claimed in claim 1 wherein the means for interconnecting said top and bottom plates comprises deformable tabs on said top plate, said tabs being bendable into overlapping mechanical interengagement with said bottom plate.

5. The connector as claimed in claim 1 wherein said second lugs are arranged at a front end of said filler piece, and wherein said filler piece is provided with a planar rear end arranged in parallel relationship with the top link of said watch band.

6. The connector as claimed in claim 1 wherein the rear end of said bottom plate is provided with upturned locking flanges adapted to coact in mechanical interengagement with one of the top and bottom end links of said watchband.

7. The connector as claimed in claim 6 wherein said locking flanges taper rearwardly to facilitate insertion of the rear end of said bottom plate between said end links.

* * * * *